US011241138B2

(12) United States Patent
Dries

(10) Patent No.: US 11,241,138 B2
(45) Date of Patent: Feb. 8, 2022

(54) FLUID CIRCULATION SYSTEM FOR DISHWASHER APPLIANCES

(71) Applicant: Haier US Appliance Solutions, Inc., Wilmington, DE (US)

(72) Inventor: John Edward Dries, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 1058 days.

(21) Appl. No.: 15/460,298

(22) Filed: Mar. 16, 2017

(65) Prior Publication Data

US 2018/0263458 A1 Sep. 20, 2018

(51) Int. Cl.
*A47L 15/42* (2006.01)

(52) U.S. Cl.
CPC ..... *A47L 15/4208* (2013.01); *A47L 15/4219* (2013.01)

(58) Field of Classification Search
None
See application file for complete search history.

(56) References Cited

U.S. PATENT DOCUMENTS 6,458,281 B2 * 10/2002 Magnoff ..... A47L 15/0094 134/111
2016/0206174 A1 7/2016 Dries
2018/0263458 A1 * 9/2018 Dries ..... A47L 15/4219
2019/0159654 A1 * 5/2019 Dries ..... A47L 15/23

FOREIGN PATENT DOCUMENTS

EP 748607 B1 3/2001
KR 20110058050 A 6/2011

OTHER PUBLICATIONS

U.S. Appl. No. 14/849,728, filed Sep. 10, 2015.
U.S. Appl. No. 14/860,806, filed Sep. 22, 2015.
U.S. Appl. No. 15/276,837, filed Sep. 27, 2016.

* cited by examiner

*Primary Examiner* — Robert J Popovics
(74) *Attorney, Agent, or Firm* — Dority & Manning, P.A.

(57) ABSTRACT

A fluid circulation system for dishwasher appliances includes a sump and a pump. The fluid circulation system further includes a filter at least partially disposed within a chamber of the sump and surrounding an impeller of the pump. The fluid circulation system includes a diverter. The fluid circulation system further includes a cleaning manifold disposed proximate an outer surface of a sidewall of the filter, the manifold defining a plurality of apertures for flowing fluid towards the outer surface of the sidewall of the filter.

15 Claims, 13 Drawing Sheets

FLUID CIRCULATION SYSTEM FOR DISHWASHER APPLIANCES

FIELD OF THE INVENTION

The subject matter of the present disclosure relates generally to dishwasher appliances, and more particularly to fluid circulation and filtration systems within dishwasher appliances.

BACKGROUND OF THE INVENTION

Dishwasher appliances generally include a tub that defines a wash compartment. Rack assemblies can be mounted within the wash chamber of the tub for receipt of articles for washing. Spray assemblies within the wash chamber can apply or direct wash fluid towards articles disposed within the rack assemblies in order to clean such articles. Multiple spray assemblies can be provided including e.g., a lower spray arm assembly mounted to the tub at a bottom of the wash chamber, a mid-level spray arm assembly mounted to one of the rack assemblies, and/or an upper spray assembly mounted to the tub at a top of the wash chamber.

Dishwasher appliances further typically include a fluid circulation system which is in fluid communication with the spray assemblies for circulating fluid to the spray assemblies. The fluid circulation system generally receives fluid from the wash chamber, filters soil from the fluid, and flows the filtered fluid to the spray assemblies. Additionally, unfiltered fluid can be flowed to a drain as required.

Some known fluid circulation systems utilize a large, flat, coarse filter and a cylindrical fine filter to filter soil. These filters are generally horizontally positioned within the fluid circulation system, and fluid typically flows through either the coarse filter or the fine filter as the fluid is flowed towards a pump of the fluid circulation system for recirculation.

More recently, improved filter arrangements have been utilized. These filters have perforated sidewalls which are generally vertically positioned and, for example, cylindrical. A pump is at least partially disposed within such a filter. Generally all wash fluid flowed to the pump is flowed through the filter. Such filter arrangements generally provide improved filtering and fluid flow relative to previously known filter arrangements.

However, some issues remain with such improved filter arrangements. For example, a fundamental issue with filters is that the filters must remain sufficiently clear to allow fluid to flow therethrough. Excess soil that remains on the filter can block such fluid flow. Accordingly, cleaning of the filter to prevent such blockages during operation is desired. One solution is to actively spray fluid at the filter to remove the soil therefrom. However, known arrangements which provide such active spraying constantly divert fluid from the spray assemblies and require that significantly more water is utilized during operation of the dishwasher appliance. The resulting increase in energy and water usage decreases the efficiency of the dishwasher appliance and is thus undesirable.

Accordingly, improved fluid circulation systems for dishwasher appliances are desired. In particular, fluid circulation systems which provide improved fluid filtering, and in particular improved filter cleaning during dishwasher appliance operation, would be advantageous.

BRIEF DESCRIPTION OF THE INVENTION

A fluid circulation system for dishwasher appliances includes a sump and a pump. The fluid circulation system further includes a filter at least partially disposed within a chamber of the sump and surrounding an impeller of the pump. The fluid circulation system includes a diverter. The fluid circulation system further includes a cleaning manifold disposed proximate an outer surface of a sidewall of the filter, the manifold defining a plurality of apertures for flowing fluid towards the outer surface of the sidewall of the filter. Additional aspects and advantages of the invention will be set forth in part in the following description, or may be obvious from the description, or may be learned through practice of the invention.

In accordance with one embodiment, a fluid circulation system for a dishwasher appliance is provided. The dishwasher appliance includes a tub that defines a wash chamber. The fluid circulation system includes a sump for receiving fluid, the sump including a chamber having a sidewall and a base wall. The fluid circulation system further includes a pump disposed within the sump chamber and the pump has an impeller. The fluid circulation system also includes a filter comprising a sidewall having an inner surface and an outer surface. The filter is at least partially disposed within the sump chamber and surrounds the impeller. The fluid circulation system further includes a cleaning manifold disposed proximate the outer surface of the sidewall of the filter, the cleaning manifold defining a plurality of apertures for flowing fluid towards the outer surface of the sidewall of the filter In accordance with another embodiment, a method of operating a fluid circulation system for a dishwasher appliance is provided. The method includes biasing a diverter disk of a diverter to a first axial position along an axial direction with a biasing element and the diverter disk is in a first circumferential position along a circumferential direction. The method further includes filtering a fluid at a filtration rate with a filter medium. The filtration rate is inversely proportional to a fouling status of the filter medium. The filter medium defines a filtered volume and the filtration rate comprising a flow rate into the filtered volume. The method further includes pressurizing the filtered fluid with a pump and supplying the filtered fluid under pressure to the diverter from the filtered volume at a pumping rate. The fluid under pressure imposes a force on the diverter disk, the force on the diverter disk overcomes the biasing element such that the diverter disk translates along the axial direction to a second axial position. The diverter disk is configured to rotate along the circumferential direction to a second circumferential position as the diverter disk translates along the axial direction. The method further includes directing fluid to flow to a first outlet of a plurality of outlets in the diverter when the diverter disk is in the second axial position and in the second circumferential position. The first outlet is in fluid communication with at least one spray arm of the dishwasher appliance. The method further includes discontinuing the supply of filtered fluid under pressure to the diverter from the filtered volume when the pumping rate exceeds the filtration rate such that a fluid level within the filtered volume is less than an intake level, whereupon the biasing element biases the diverter disk back to the first axial position, the diverter disk rotating along the circumferential direction to a third circumferential position as the diverter disk translates along the axial direction. Filtered fluid continues to accumulate in the filtered volume while the supply of filtered fluid under pressure to the diverter from the filtered volume is discontinued. The method further includes resuming supply of the filtered fluid under pressure to the diverter from the filtered volume at the pumping rate when filtered fluid accumulates in the filtered volume to at least the intake level. The fluid under pressure imposes a force on the diverter disk and the force on the diverter disk overcomes the biasing element, such that the diverter disk translates along the axial direction to the second axial position, the diverter disk configured to rotate along a circumferential direction to a fourth circumferential position as the diverter disk translates along the axial direction. The method further includes directing fluid to flow to a second outlet of the plurality of outlets in the diverter when the diverter disk is in the second axial position and in the fourth circumferential position. The second outlet is in fluid communication with a cleaning manifold. The method further includes directing fluid from the cleaning manifold towards an upstream surface of the filter medium when the diverter disk is in the second axial position and the fourth circumferential position, whereby the fouling status of the filter medium is reduced.

These and other features, aspects, and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention including the best mode thereof, directed to one of ordinary skill in the art, is set forth in the specification, which makes reference to the appended figures, in which.

DETAILED DESCRIPTION OF THE INVENTION

Figure 1:
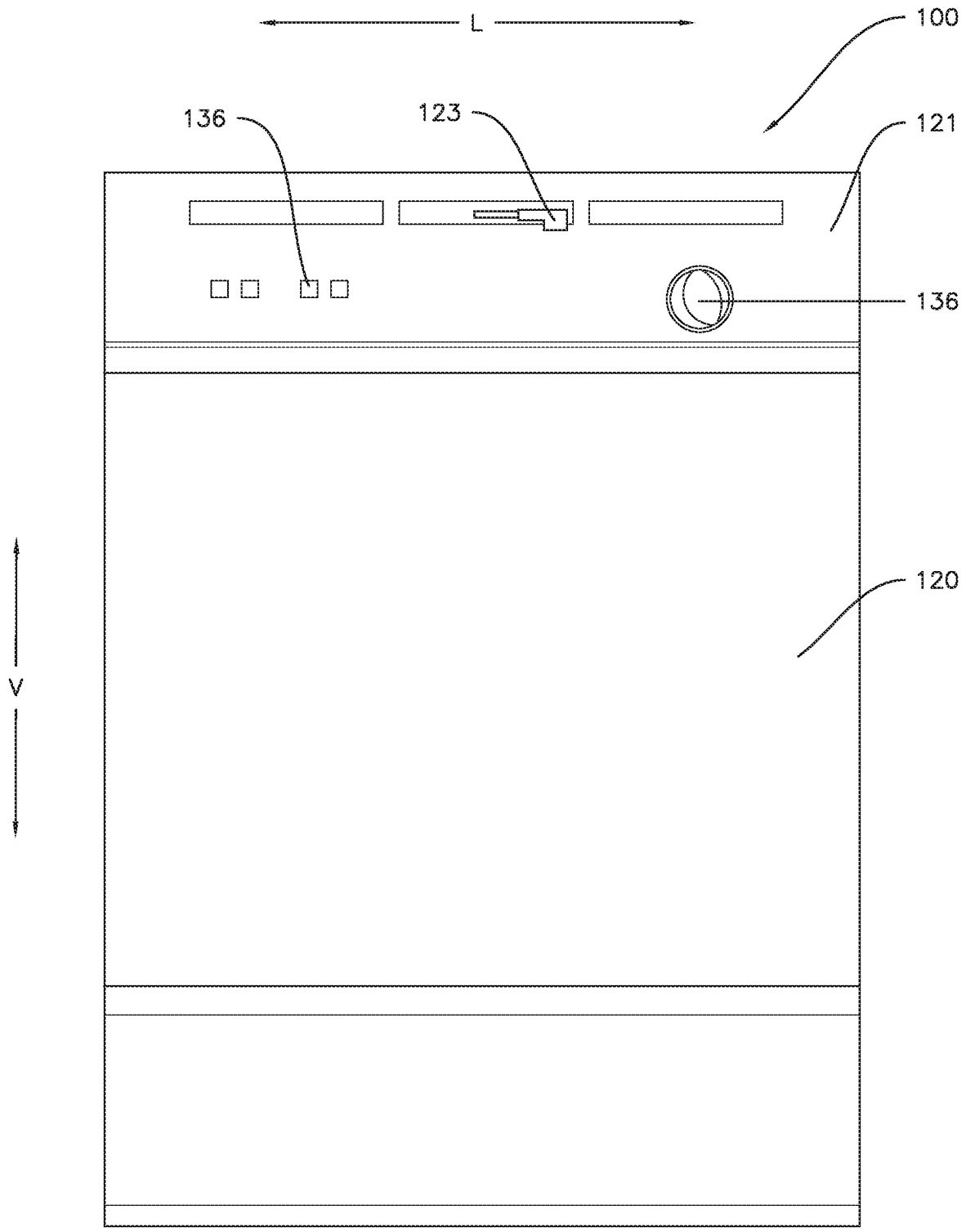
FIG. 1 provides a front view of a dishwasher appliance in accordance with one embodiment of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "article" may refer to, but need not be limited to, dishes, pots, pans, silverware, and other cooking utensils and items that can be cleaned in a dishwashing appliance. The term "wash cycle" is intended to refer to one or more periods of time during the cleaning process where a dishwashing appliance operates while containing articles to be washed and uses a detergent and water to, e.g., remove soil particles including food and other undesirable elements from the articles. The term "rinse cycle" is intended to refer to one or more periods of time during the cleaning process in which the dishwashing appliance operates to remove residual soil, detergents, and other undesirable elements that were retained by the articles after completion of the wash cycle. The term "drying cycle" is intended to refer to one or more periods of time in which the dishwashing appliance is operated to dry the articles by removing fluids from the wash chamber. The term "fluid" refers to a liquid used for washing and/or rinsing the articles and is typically made up of water that may include additives such as e.g., detergent or other treatments.

As used herein, the terms "first," "second," and "third" may be used interchangeably to distinguish one component from another and are not intended to signify location or importance of the individual components. The terms "upstream" and "downstream" refer to the relative direction with respect to fluid flow in a fluid pathway. For example, "upstream" refers to the direction from which the fluid flows, and "downstream" refers to the direction to which the fluid flows. The term "radially" refers to the relative direction that is substantially perpendicular to an axial centerline of a particular component, the term "axially" refers to the relative direction that is substantially parallel and/or coaxially aligned to an axial centerline of a particular component and the term "circumferentially" refers to the relative direction that extends around the axial centerline of a particular component.

The terminology used herein is for the purpose of describing particular embodiments only and is not intended to be limiting. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Figure 2:
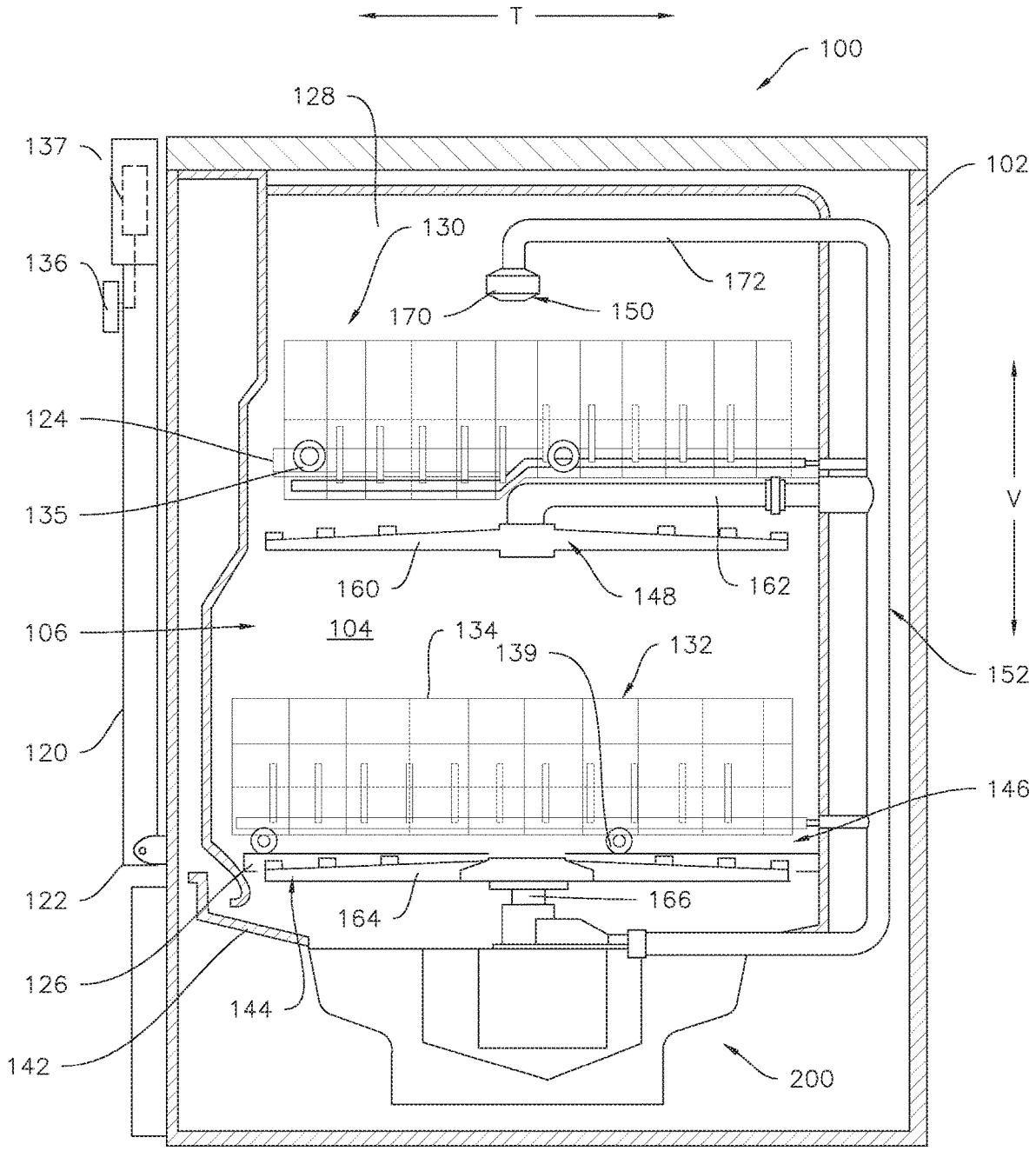
FIG. 2 provides a side, cross-sectional view of a dishwasher appliance in accordance with one embodiment of the present disclosure.

FIGS. 1 and 2 depict an exemplary domestic dishwasher appliance 100 that may be configured in accordance with aspects of the present disclosure. For the particular embodiment of FIGS. 1 and 2, the dishwasher appliance 100 includes a cabinet 102 having a tub 104 therein that defines a wash chamber 106. As shown, the dishwasher appliance 100 (such as the cabinet 102 thereof) defines a vertical direction V, a lateral direction L, and a transverse direction T, which are mutually orthogonal and define a coordinate system for the dishwasher appliance. The tub 104 includes a front opening (not shown) and a door 120 hinged at its bottom 122 for movement between a normally closed vertical position (shown in FIGS. 1 and 2), wherein the wash chamber 106 is sealed shut for washing operation, and a horizontal open position for loading and unloading of articles from the dishwasher. A latch 123 may be used to lock and unlock door 120 for access to chamber 106.

Upper and lower guide rails 124, 126 are mounted on tub side walls 128 and accommodate roller-equipped rack assemblies 130 and 132. Each of the rack assemblies 130, 132 is fabricated into lattice structures including a plurality of elongated members 134 (for clarity of illustration, not all elongated members making up assemblies 130 and 132 are shown in FIG. 2). Each rack 130, 132 is adapted for movement between an extended loading position (not shown) in which the rack is substantially positioned outside the wash chamber 106, and a retracted position (shown in FIGS. 1 and 2) in which the rack is located inside the wash chamber 106. This is facilitated by rollers 135 and 139, for example, mounted onto racks 130 and 132, respectively. A silverware basket (not shown) may be removably attached to rack assembly 132 for placement of silverware, utensils, and the like, that are otherwise too small to be accommodated by the racks 130, 132.

The dishwasher appliance 100 further includes a lower spray-arm assembly 144 that is rotatably mounted within a lower region 146 of the wash chamber 106 and above a bottom wall 142 of the tub 104 so as to rotate in relatively close proximity to rack assembly 132. A mid-level spray-arm assembly 148 is located in an upper region of the wash chamber 106 and may be located in close proximity to upper rack 130. Additionally, an upper spray assembly 150 may be located above the upper rack 130.

Each spray assembly 144, 148, 150 may include a spray arm or other sprayer and a conduit in fluid communication with the sprayer. For example, mid-level spray-arm assembly 148 may include a spray arm 160 and a conduit 162. Lower spray-arm assembly 144 may include a spray arm 164 and a conduit 166. Additionally, upper spray assembly 150 may include a spray head 170 and a conduit 172 in fluid communication with the spray head 170. Each spray assembly 144, 148, 150 includes an arrangement of discharge ports or orifices for directing washing liquid received from diverter 300 onto dishes or other articles located in rack assemblies 130 and 132. The arrangement of the discharge ports in spray-arm assemblies 144 and 148 provides a rotational force by virtue of washing fluid flowing through the discharge ports. The resultant rotation of the spray-arm assemblies 144 and 148 and the operation thereof using fluid from diverter 300 provides coverage of dishes and other dishwasher contents with a washing spray. Other configurations of spray assemblies may be used as well. For example, dishwasher 100 may have additional spray assemblies for cleaning silverware, for scouring casserole dishes, for spraying pots and pans, for cleaning bottles, etc.

The lower and mid-level spray-arm assemblies 144, 148 and the upper spray assembly 150 are part of a fluid circulation system 152 for circulating fluid in the dishwasher appliance 100. The fluid circulation system 152 also includes various components for receiving fluid from the wash chamber 106, filtering the fluid, and flowing the fluid to the various spray assemblies such as the lower and mid-level spray-arm assemblies 144, 148 and the upper spray assembly 150.

Each spray assembly 144, 148, 150 may receive an independent stream of fluid, may be stationary, and/or may be configured to rotate in one or both directions. For example, a single spray arm may have multiple sets of discharge ports, each set receiving wash fluid from a different fluid conduit, and each set being configured to spray in opposite directions and impart opposite rotational forces on the spray arm. In order to avoid stalling the rotation of such a spray arm, wash fluid is typically only supplied to one of the sets of discharge ports at a time.

The dishwasher appliance 100 is further equipped with a controller 137 to regulate operation of the dishwasher appliance 100. The controller may include one or more memory devices and one or more microprocessors, such as general or special purpose microprocessors operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor.

The controller 137 may be positioned in a variety of locations throughout dishwasher appliance 100. In the illustrated embodiment, the controller 137 may be located within a control panel area 121 of door 120 as shown in FIGS. 1 and 2. In such an embodiment, input/output ("I/O") signals may be routed between the control system and various operational components of dishwasher 100 along wiring harnesses that may be routed through the bottom 122 of door 120. Typically, the controller 137 includes a user interface panel/controls 136 through which a user may select various operational features and modes and monitor progress of the dishwasher 100. In one embodiment, the user interface 136 may represent a general purpose I/O ("GPIO") device or functional block. In one embodiment, the user interface 136 may include input components, such as one or more of a variety of electrical, mechanical or electro-mechanical input devices including rotary dials, push buttons, and touch pads. The user interface 136 may include a display component, such as a digital or analog display device designed to provide operational feedback to a user. The user interface 136 may be in communication with the controller 137 via one or more signal lines or shared communication busses. It should be noted that controllers 137 as disclosed herein are capable of and may be operable to perform any methods and associated method steps as disclosed herein.

It should be appreciated that the invention is not limited to any particular style, model, or configuration of dishwasher. The exemplary embodiment depicted in FIGS. 1 and 2 is for illustrative purposes only. For example, different locations may be provided for user interface 136, different configurations may be provided for racks 130, 132, different combinations of spray assemblies may be utilized, and other differences may be applied as well.

Figure 3:
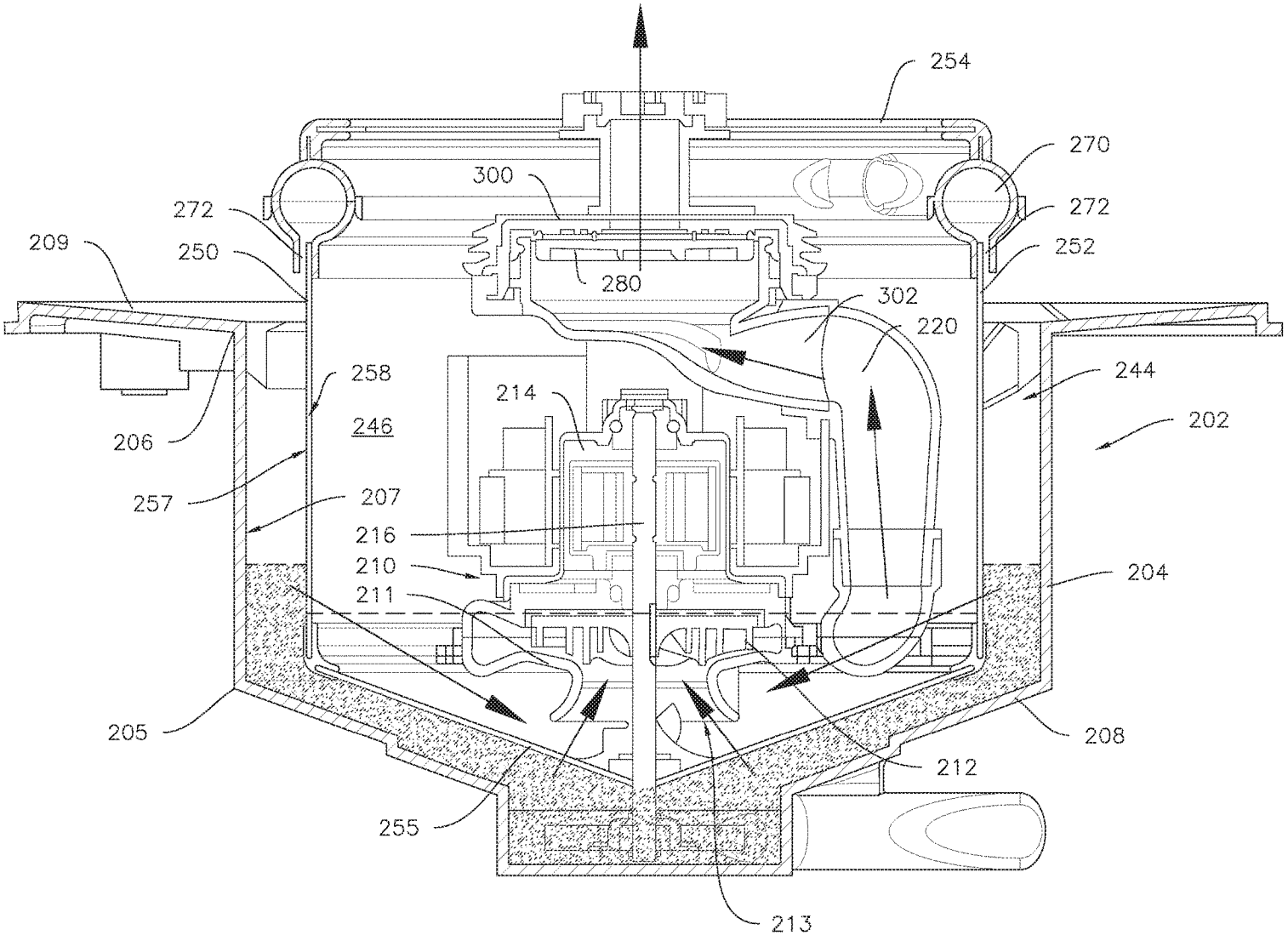
FIG. 3 provides a cross-sectional view of a fluid circulation system for a dishwasher appliance with a diverter in a first position in accordance with one embodiment of the present disclosure.
Figure 4:
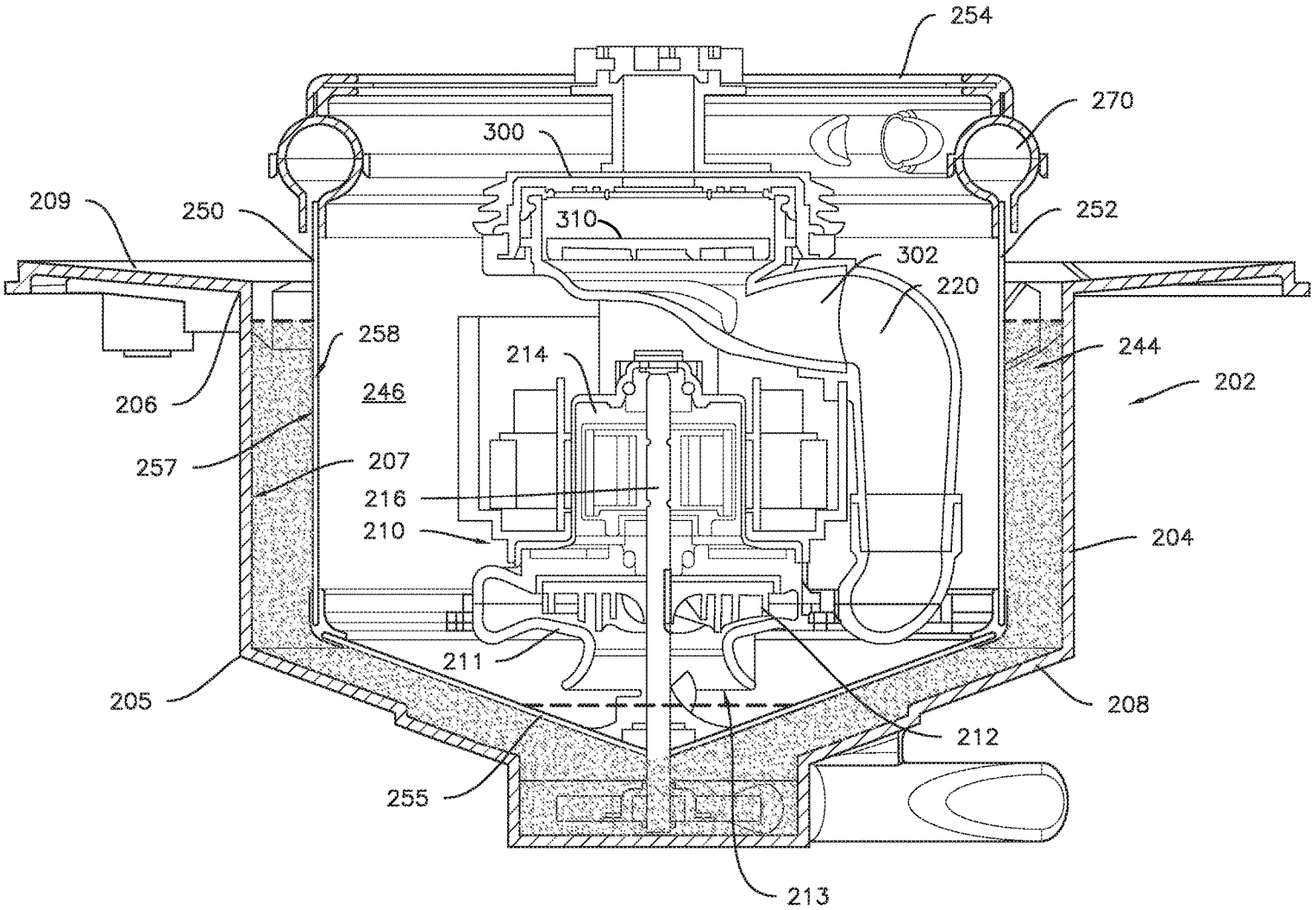
FIG. 4 provides a cross-sectional view of the fluid circulation system of FIG. 3 with the diverter in a second position.
Figure 5:
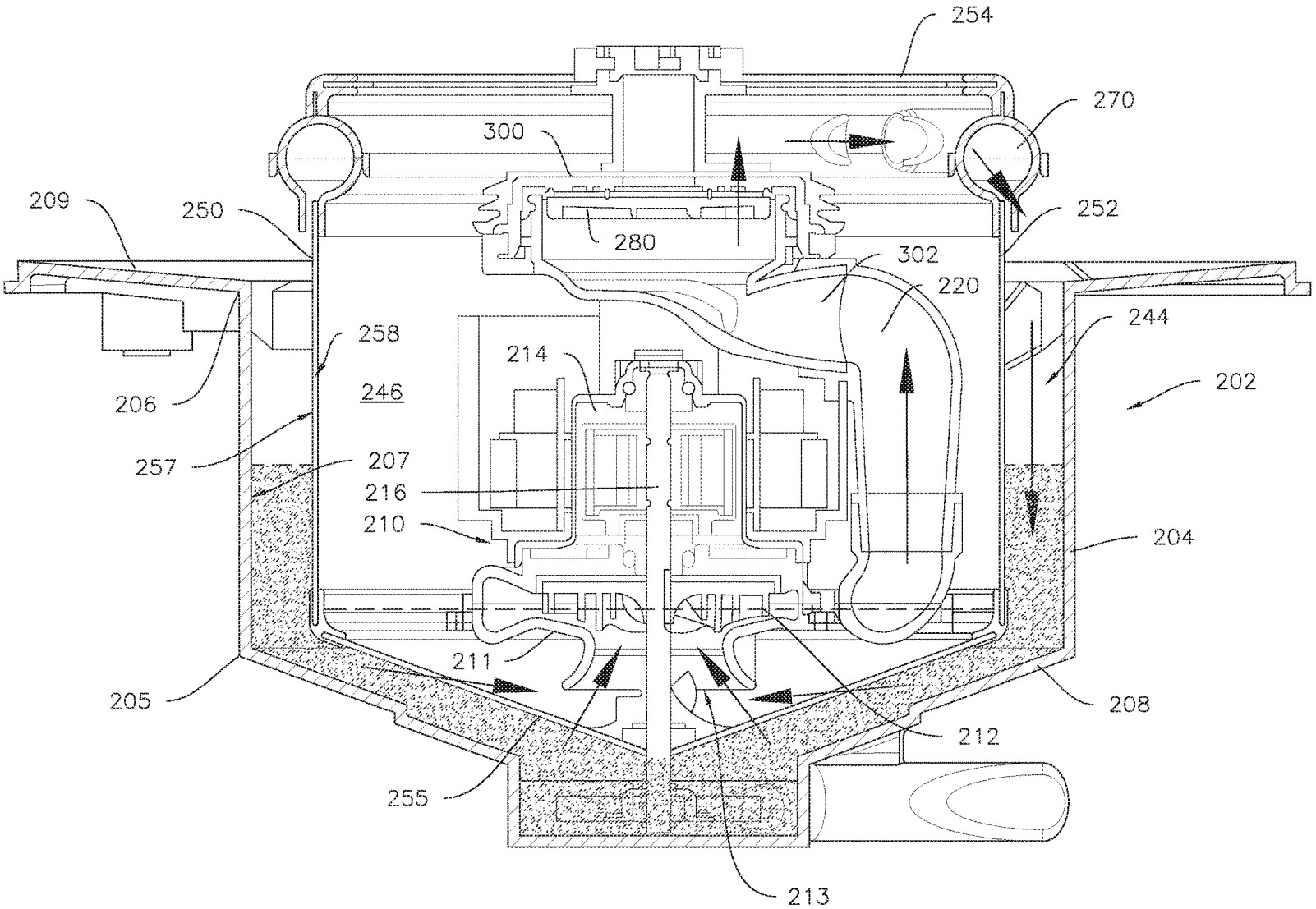
FIG. 5 provides a cross-sectional view of the fluid circulation system of FIG. 3 with the diverter in a third position.

Referring now to FIGS. 3 through 5, embodiments of portions of the fluid circulation system 152 of a dishwasher appliance 100 are illustrated. As shown, system 152 may include, for example, a sump 200 (shown in FIG. 2) for receiving fluid from the wash chamber 106. The sump 200 may be mounted to the bottom wall 142 and fluid may for example flow from the bottom wall 142 into the sump 200.

Sump 200 may include and define, for example, a chamber 202 which receives the fluid from the wash chamber 106. As illustrated, sump 200 may include a sidewall 204 and a base wall 208 which define the chamber 202. For example, an inner surface 207 of the sidewall 204 may defined the chamber 202. The sidewall 204 may extend from the base wall 208, such as generally along the vertical direction V. As used herein, "generally" in the context of an angle or direction means within ten degrees, e.g., generally along the vertical direction may include within ten degrees of vertical. In some embodiments, the sidewall 204 may have a generally circular cross-sectional shape. Alternatively, the sidewall 204 may have a generally rectangular or other suitable polygonal cross-sectional shape, with multiple linear or curvilinear portions. Sidewall 204 may extend between a bottom end 205 (which may be connected to the base wall 208) and a top end 206 (which may be spaced from the base wall 208 along the vertical direction V).

Sump 200 may additionally include a skirt 209. The skirt 209 may extend from the sidewall 204, such as from the top end 206, away from the chamber 202 and away from a filter 250 disposed at least partially within the chamber 202 (as discussed herein). For example, the skirt 209 may extend generally perpendicularly to sidewall 204 and/or generally radially from the sidewall 204. As noted above, generally perpendicular is understood to include forming an angle within ten degrees of perpendicular, e.g., from seventy degrees to one hundred degrees, similarly, generally radial includes within ten degrees of radial. Fluid flowing into the chamber 202 may flow along skirt 209 until the skirt 209 reaches the sidewall 204, and the fluid may then flow into the chamber 202. Skirt 209 may, for example, be mounted to bottom wall 142.

System 152 may further include a pump 210 which provides pressurized fluid flow to a diverter 300 via a conduit 220. Pump 210 may include an impeller 212 which is disposed within the chamber 202. In some embodiments, the impeller 212 may be enclosed within a housing 211, and the housing 211 may include an intake 213 for drawing fluid into pump 210, e.g., to the impeller 212. Pump 210 may further include a motor 214 and a shaft 216 which connects the motor 214 and impeller 212. For example, the motor 214 may be disposed within the chamber 202, and may be hermetically sealed to prevent damage thereto from fluids within the chamber 202. Alternatively, the shaft 216 may extend through the base wall 208, and the motor 214 may be external to the chamber 202. Impeller 212 may spin within the chamber 202 when activated by the motor 214 to influence the flow of fluid within the chamber 202.

As further illustrated, a filter 250 may be disposed at least partially within the chamber 202. As shown, the filter 250 surrounds the impeller 212, and can additionally surround other components of the pump 210 such as the motor 214. As illustrated, a filter 250 in accordance with the present disclosure may include a sidewall 252. Filter 250 may further include a top wall 254. Still further, filter 250 may include a base wall 255. The sidewall 252 may extend generally along the vertical direction V, e.g., within 10 degrees of vertical, and between the top wall 254 and bottom wall 255. Accordingly, the filter 250 may define an unfiltered volume 244 and a filtered volume 246 within the sump chamber 202. That is, the unfiltered volume 244 may be the portion of sump chamber 202 upstream of the filter 250 with respect to a primary flow direction and the filtered volume 246 may be the portion of sump chamber 202 downstream of the filter 250 with respect to the primary flow direction. Further, it is understood that the unfiltered volume 244 is unfiltered relative to the filter 250. In some embodiments, the sidewall 252 may have a generally circular cross-sectional shape, as illustrated in FIG. 3. Alternatively, the sidewall 252 may have a generally rectangular or other suitable polygonal cross-sectional shape, with multiple linear or curvilinear portions.

The sidewall 252 may include a filter media defining an outer surface 257 and an inner surface 258 of the sidewall 252. Some embodiments may include filter media, e.g., screen or mesh, having pore or hole sizes in the range of about four thousandths (0.004 or $^{4}/_{1000}$) of an inch to about eighty thousandths (0.08 or $^{80}/_{1000}$) of an inch in diameter, or the pores may otherwise be sized and shaped to allow fluid flow therethrough, while preventing the flow of soil therethrough, thus filtering the fluid as the fluid flows into the filter 250 through the walls thereof.

As further illustrated, system 152 may further include a cleaning manifold 270. The cleaning manifold may be configured to provide fluid to the outer surface 257 of the filter sidewall 252 for cleaning of the sidewall 252. In particular, fluid flowing through the outlet conduit 220 may, as discussed herein, be diverted to the manifold 270. The fluid in the manifold 270 may then be flowed from the manifold 270 towards and onto the outer surface 257. The flow of fluid onto and on the outer surface 257 may advantageously clean the sidewall 252 by dislodging and removing soil from the sidewall 252. In exemplary embodiments, the fluid exhausted from the cleaning manifold 270 may be exhausted in a plurality of streams, which may for example, be relatively high velocity jets of fluid, towards the outer surface 257. The fluid may, for example, be exhausted generally along the vertical direction V onto the outer surface 257, and may flow generally along the vertical direction V (e.g., generally parallel to the outer surface 257) to clean the sidewall 252.

Cleaning manifold 270 may be disposed proximate the outer surface 257, and may for example wrap around at least a portion of the perimeter of the sidewall 252. As illustrated, manifold 270 may for example contact the outer surface 257. Further, in exemplary embodiments, manifold 270 may be disposed proximate the top wall 254. A plurality of apertures 272 may be defined in the manifold 270 for flowing fluid therethrough. Each aperture 272 may be oriented to direct fluid exhausted therefrom towards the outer surface 257. For example, fluid exhausted from each aperture 272 may be flowed generally along the vertical direction V and along the outer surface 257.

System 152 may further include a diverter 300. Diverter 300 may be configured for selectively flowing fluid to the wash chamber 106 (such as via one or more of the spray assemblies) or to the cleaning manifold 270, depending on the position of the valve 310. Use of such a diverter 300 in accordance with the present disclosure may advantageously provide improved cleaning of the filter 250 without requiring an increase in water usage or an increase in energy usage or motor size. Such improved cleaning is provided by, for example, selective diversion of the fluid to the cleaning manifold 270 for periodic amounts of time to clean the filter 250, such as the sidewall 252 thereof, as needed. Further, as discussed herein, the diverter 300 may advantageously only be utilized to divert fluid to the cleaning manifold 270 when cleaning is needed, and may automatically select between flowing fluid to the wash chamber 106 (such as via one or more of the spray assemblies) or to the cleaning manifold 270.

In interest of brevity, the exemplary diverter 300 is only described generally. For more detail, exemplary diverters are described in U.S. application Ser. No. 15/276,837 of Ross, et al., and U.S. application Ser. No. 14/849,728 of Boyer, et al., both of which are incorporated herein by reference in their entirety.

Figure 7:
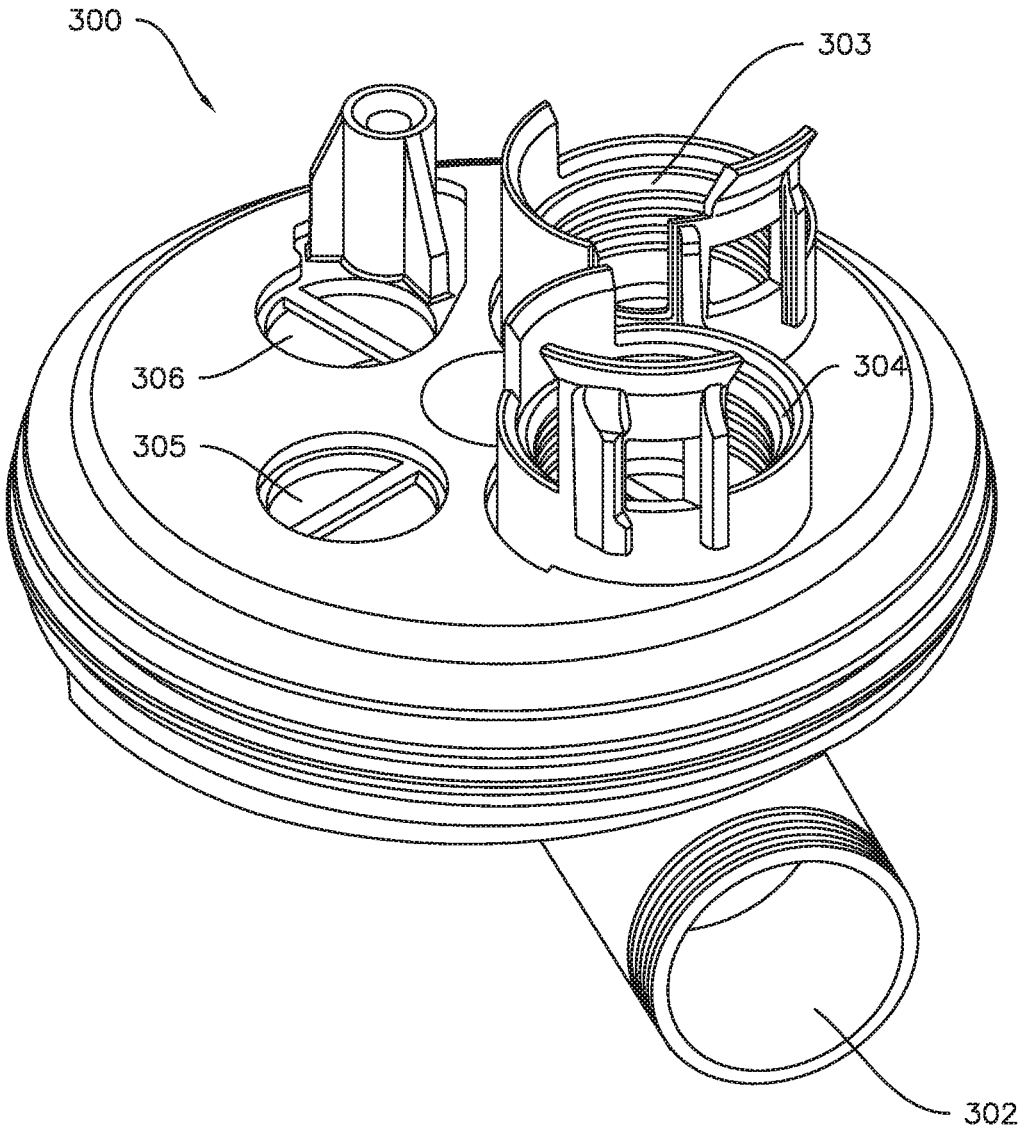
FIG. 7 provides a perspective view of a diverter according to an exemplary embodiment of the present disclosure.

As shown in FIG. 7, an exemplary diverter 300 may include an inlet 302 in fluid communication with the pump 210, e.g., via conduit 220, for receiving a flow of fluid from pump 210 that is to be supplied to spray assemblies 144, 148, and/or 150 or cleaning manifold 270, as well as other fluid-using components during cleaning operations. As stated, pump 210 receives fluid from, e.g., sump 200 and provides a fluid flow to diverter 300. The exemplary diverter 300 includes a plurality of outlets, e.g., as illustrated in FIG. 7, the diverter 300 may include four outlets, including first outlet 303, second outlet 304, third outlet 305, and fourth outlet 306. Diverter 300 includes a valve 310 (see, e.g., FIG. 8), more fully described below, that can be selectively switched between outlets 303, 304, 305, and 306 by hydraulic actuation.

By way of example, first outlet 303 can be fluidly connected with upper spray assembly 150 and lower spray arm assembly 144 and second outlet 304 can be fluidly connected with mid-level spray arm assembly 148. Third outlet 305 may be fluidly connected with another fluid-using component, e.g., for cleaning silverware. Fourth outlet 306 may be fluidly connected to cleaning manifold 270. Other spray assemblies and connection configurations may be used as well. As such, the rotation of valve 310 in diverter 300 can be used to selectively place pump 210 in fluid communication with spray assemblies 144, 148, or 150, another fluid-using component, or cleaning manifold 270, by way of outlets 303, 304, 305, and 306, as described in an exemplary embodiment below.

In other embodiments of the invention, two, three, or more than four outlets may be provided in diverter 300 depending upon e.g., the number of switchable outlets desired for selectively placing pump 210 in fluid communication with different fluid-using elements of appliance 100. For example, in some embodiments, the plurality of outlets may include a first outlet and a second outlet, the second outlet in fluid communication with the cleaning manifold 270. In some embodiments, the first outlet may be in fluid communication with one or more spray assemblies 144, 148, and/or 150, such as lower spray arm 144 and/or upper spray assembly 150. Also, some embodiments of the plurality of outlets may further include a third outlet in fluid communication with others of the spray assemblies 144, 148, and/or 150, such as mid-level spray arm 148. As used herein, the terms "first," "second," and "third" do not necessarily denote order or sequence, e.g., in the foregoing example embodiments, the diverter may be configured to provide flow to the third outlet before the second outlet.

Figure 8:
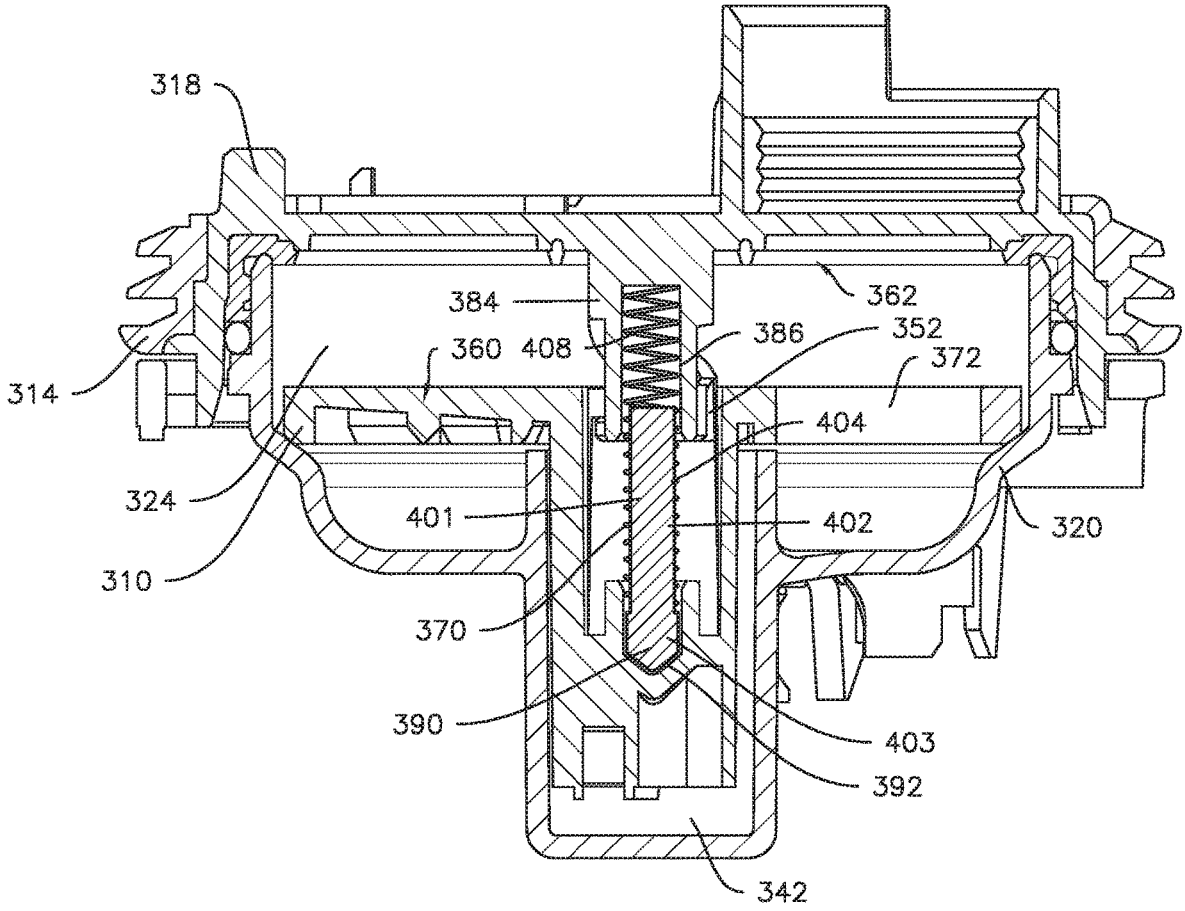
FIG. 8 provides a cross-sectional view of the exemplary diverter of FIG. 7 with a diverter valve shown in a first position.
Figure 9:
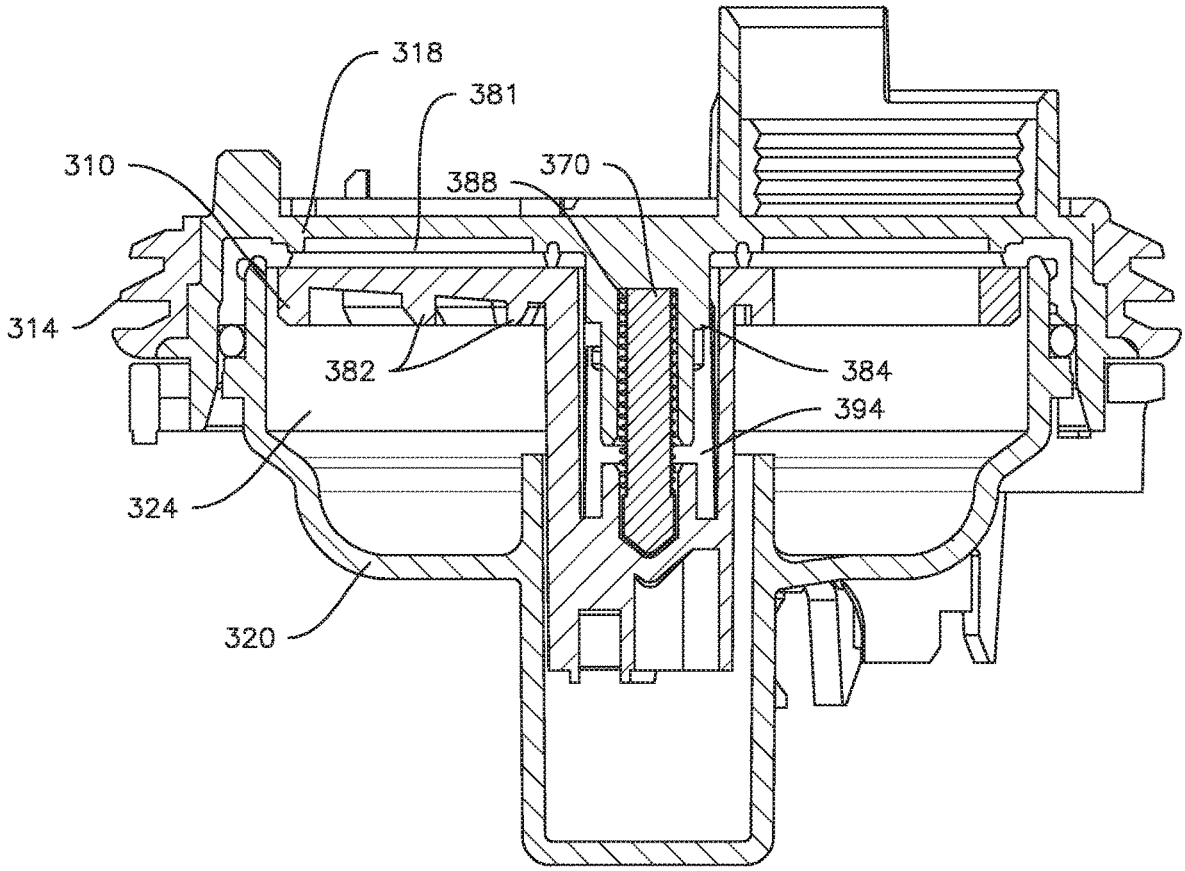
FIG. 9 provides a cross-sectional view of the exemplary diverter of FIG. 7 with a diverter valve shown in a second position.

As may be seen in FIGS. 8 and 9, the exemplary diverter 300 includes a housing 314. Housing 314 includes two portions which are spaced apart, e.g., along the vertical direction V. Thus, in the illustrated example, the housing 314 includes an upper portion 318 and a lower portion 320, however, the terms "upper" and "lower" are used by way of example only and without limitation. Rather, portion 318 and portion 320 may be spaced apart along any suitable direction depending on the particular configuration of pump 210 and diverter 300. Housing 314 defines a chamber 324 into which fluid flows through fluid inlet 302. Chamber 324 also provides fluid communication to one or more of the outlets 303, 304, 305 and 306. Valve 310 (best seen in FIG. 10) is positioned within chamber 324 and defines an axial direction A, a radial direction R, and a circumferential direction C (see, e.g., FIG. 10). More particularly, valve 310 includes a circular main body or disk 356 with at least one aperture 372 defined therein, and a cylindrical shaft 340 that extends along the axial direction A and is received into a cylindrical well 342 formed in housing 314. This cylindrical shaft 340 is slidably received within the well 342 of the housing 314, such that valve 310 is rotatable about the axial direction A, e.g., along the circumferential direction C, relative to housing 314 and movable back and forth along axial direction A.

As can be seen by comparing FIGS. 8 and 9, valve 310 is movable along the axial direction A between a first position shown in FIG. 8 and a second position shown in FIG. 9. In the first position shown in FIG. 8, valve 310 rests on lower portion 320 of housing 314. In the second position shown in FIG. 9, valve 310 is pressed against upper portion 318 of housing 314. For this exemplary embodiment, a top surface 360 (FIG. 10) of valve 310 contacts an interior surface 362 (FIG. 11) of housing 314 when valve 310 is in the second position.

Movement of valve 310 back and forth between the first position shown in FIG. 8 and the second position shown in FIG. 9 is provided by two opposing forces: i) a flow of fluid, e.g., water, passing through diverter 300 that is counteracted by ii) a biasing element 370. More particularly, when pump 310 is off, biasing element 370 pushes along axial direction A against valve 310 and forces valve 310 in a first direction, e.g., downward, along the axial direction A to the position shown in FIG. 8. Conversely, when there is a sufficient flow of fluid through diverter housing 314, the momentum of the fluid will impact valve 310, this momentum overcomes the force provided by biasing element 370 so as to shift valve 310 along axial direction A in a second direction opposing the first direction, e.g., upward and away from diverter lower portion 320 towards diverter upper portion 318, to the second position shown in FIG. 9.

Figure 10:
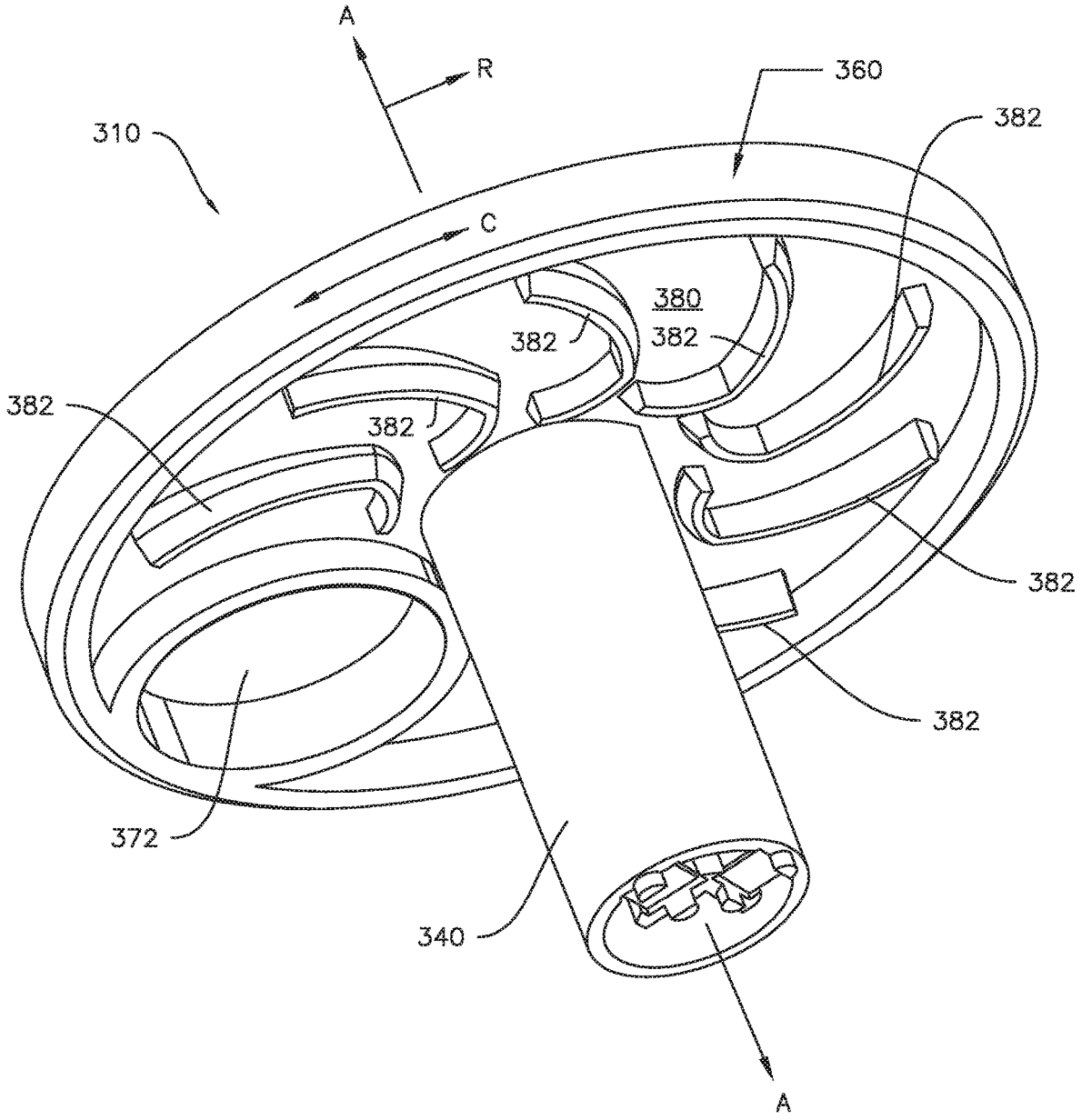
FIG. 10 provides a perspective view of the diverter valve of FIGS. 8 and 9.

Disk 356 assists in capturing the momentum provided by fluid flow through chamber 324. In addition, as shown in FIG. 10, a bottom surface 380 of disk 356 of valve 310 may further include a plurality of arcuate ribs 382. These arcuate ribs 382 capture the momentum and of the fluid flow and tend to cause the valve 310 to rotate in only one direction. The arcuate ribs 382 cause the valve 310 to rotate in a clockwise manner about axial direction A when viewed from bottom of valve 310. As shown in FIG. 10, the disk 256 may include a plurality of arcuate ribs 382, one skilled in the art will appreciate that any number of arcuate ribs may be used. Similarly, the ribs may be different size, shape, or orientation depending on the needs of the application.

Valve 310 will remain in the second position until the fluid flow ends or drops below a certain flow rate. Then, biasing element 370 urges valve 310 along axial direction A away from diverter upper portion 318 towards diverter lower portion 320 and back into the first position shown in FIG. 8. As shown in the exemplary embodiment of FIGS. 8 and 9, the biasing element 370 extends between a boss 384 on the upper portion 318 of the housing 314 and the valve shaft 340 and is configured to urge the valve 310 toward the first position. In this regard, boss 384 may define a recess 386 into which a top end 388 of the biasing element 370 may be slidably received, and a bottom end 390 of the biasing element 370 may be received in a conically-shaped seat 392 defined, for example, at the bottom of an interior channel 394 of valve shaft 340. The biasing element 370 of the illustrated embodiment in FIGS. 8 and 9 includes a plunger 402 and a compression spring 408. Plunger 402 may, for example, include a shaft 401 and a head 403, the plunger head 403 may have a larger diameter than the plunger shaft 401 and a compression spring 408 may be received onto the plunger shaft 401 and compressed against the plunger head 403. One skilled in the art will appreciate that the illustrated biasing element is only an example, and other types of biasing elements are possible. For example, in some embodiments, the biasing element may be a simple compression spring.

The movement of valve 310 back and forth along the axial direction A between the first and second positions shown in FIGS. 8 and 9 also causes valve 310 to rotate about the axial direction A so that the aperture 372 switches between outlets 303, 304, 305, and 306. For this exemplary embodiment, a single movement in either direction, e.g., from the first position to the second position or vice versa, causes valve 310 to rotate forty-five degrees. Accordingly, valve 310 rotates about the axial direction A by a total of ninety degrees each time valve 310 is moved out of, and then returned to, the second position (FIG. 9).

Figure 6:
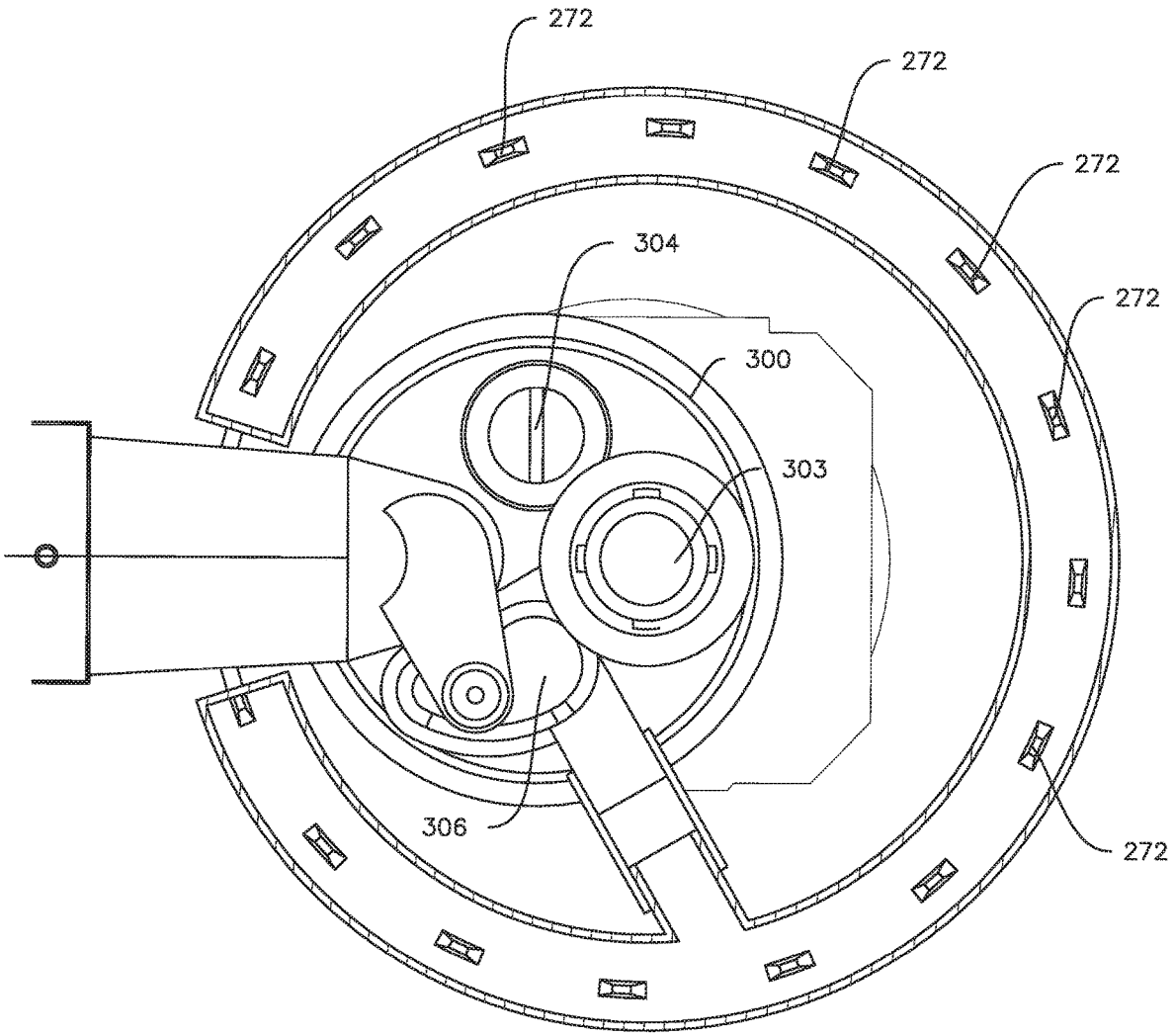
FIG. 6 provides a top-down view of the fluid circulation system of FIG. 3.

As noted above, disk 356 of valve 310 may include an aperture 372, which may be selectively placed in fluid communication with one of outlets 303, 304, 305, and 306 to provide fluid flow to spray assemblies 144, 148, and 150, etc. For example, disk 256 may be rotated so as to place aperture 372 in fluid communication with one of outlets 303, 304, 305, and 306. In other embodiments, it is also possible to provide two or more apertures which may be in fluid communication with one or more of the outlets 303, 304, 305, and 306 at a time. As shown in FIGS. 6 and 7, fluid outlets 303, 304, 305, and 306 are spaced apart circumferentially on upper portion 318 of housing 314 by ninety degrees. Thus, each time valve 310 travels from and then returns to the second position, as described above, the valve 310, and more particularly the aperture 372 in the disk 356 thereof, rotates ninety degrees and thereby moves from one outlet, e.g., first outlet 303, to the next outlet, e.g., second outlet 304.

As described below, the diverter 300 may include a positioning assembly for rotating the valve 310, and in particular the diverter disk 356 thereof, about the axial direction incrementally through a plurality of angular positions. For example, each incremental rotation may include a first rotation as the valve 310 travels from the second position to the first position along the axial direction A and a second rotation as the valve 310 returns to the second position from the first position. The plurality of angular positions of the disk 356 may correspond to the plurality of outlets 303, 304, 305, and 306 from the diverter 300 such that the aperture 372 is aligned with a respective one of the plurality of outlets 303, 304, 305, and 306 in each of the plurality of angular positions. In various embodiments, the plurality of angular positions may include two angular positions spaced apart by one hundred and eighty degrees and the plurality of outlets may include two outlets spaced apart by one hundred and eighty degrees, the plurality of angular positions may include three angular positions spaced apart by sixty degrees and the plurality of outlets may include three outlets spaced apart by sixty degrees, or the plurality of angular positions may include four angular positions spaced apart by ninety degrees and the plurality of outlets may include four outlets spaced apart by ninety degrees. Several other variations and combinations are possible, for example, the disk 356 may include a plurality of apertures 372 and may rotate through a greater number of angular positions than there are outlets, e.g., to selectively provide fluid flow to one or more outlets at a time.

Although the illustrated embodiment shows a valve 310 including diverter disk 356 having one aperture 372 and rotating in ninety degree increments, one skilled in the art will appreciate that this configuration is provided only as an example. Diverter disk 256 may have more apertures and may be indexed in different increments. Similarly, housing 314 may have more or fewer than four outlets. For example, the disk 356 may rotate in one hundred twenty degree increments such that the aperture 372 travels between three outlets, the three outlets equidistantly spaced apart along the circumferential direction of upper portion 318 of housing 314.

Figure 11:
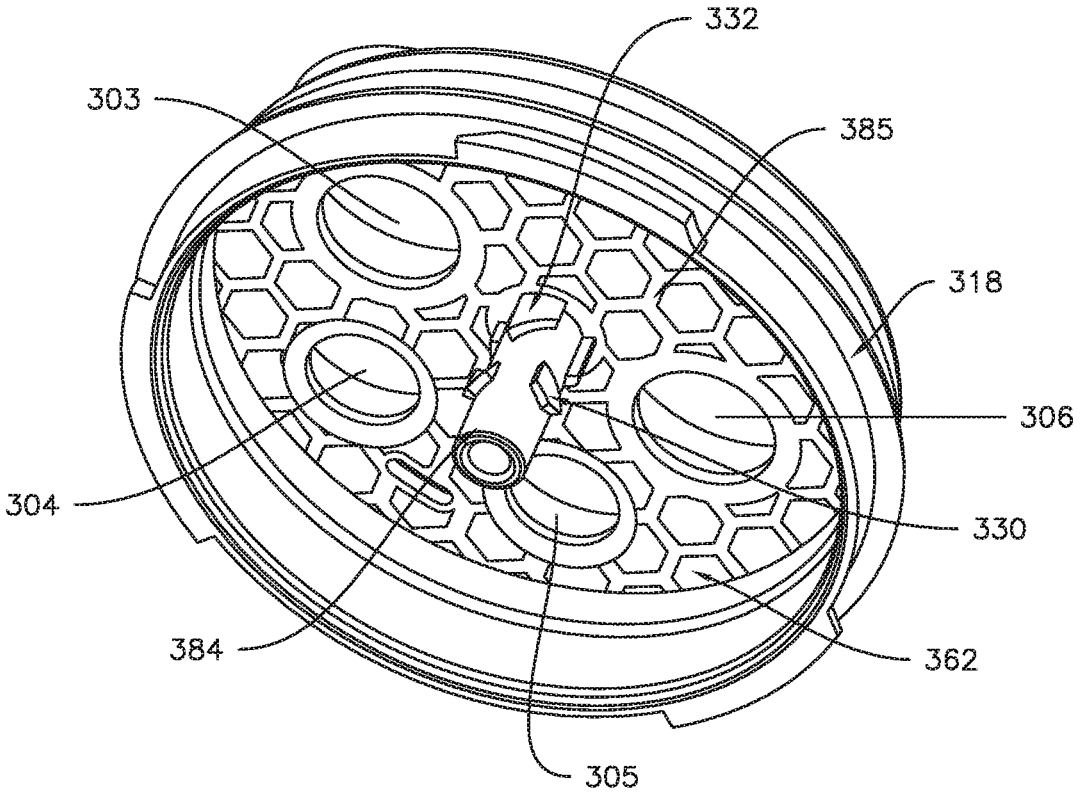
FIG. 11 provides a perspective view of a portion of the exemplary diverter of FIG. 7.

A positioning assembly including a plurality of guide element 330, 332 and/or positioning cams 352 may be provided in some exemplary embodiments. Referring now to FIG. 11, a cylindrically-shaped boss 384 extends along axial direction A from upper portion 318 of housing 314 into an interior channel 394 (FIGS. 8 and 9) defined by valve 310. As mentioned above, boss 384 defines recess 386 into which a first end 388 of biasing element 370 is received. Boss 384 also includes a plurality of guide elements 330 and 332 that are spaced apart from each other along circumferential direction C and extend radially outward from the boss 384. Upper guide elements 330 and lower guide elements 332 are spaced apart along axial direction A and are also offset from each other along circumferential direction C. More particularly, as best seen in FIG. 11, along axial direction A, each of upper guide elements 332 is aligned with a gap positioned between a respective pair of the lower guide elements 330. Conversely, each of lower guide elements 330 is aligned with a gap between a respective pair of upper guide elements 332.

As stated and shown, boss 384 is received into an interior channel 394 defined by the shaft 340 of valve 310. As may be seen in FIGS. 8 and 9, a plurality of cams 352 are positioned on the interior channel 394 of the cylindrical valve shaft 340 and project radially inward (i.e., along radial direction R) from cylindrical shaft 340 into interior channel 394. Each cam 352 is spaced apart from adjacent cams 352 along the circumferential direction C, and each cam 352 is at the same axial position along the axial direction A. Accordingly, as described herein, one of skill in the art will appreciate that the guide elements 330, 332 and the cams 352 are configured to contact each other when the valve 310 moves into the second position so as to cause the valve 310 to rotate incrementally through a plurality of angular positions, e.g., to rotate forty five degrees as valve 310 travels from the first position to the second position, as described above. Further details of possible configurations for the guide elements 330, 332 and the cams 352 may be found by reference to the above-mentioned applications of Ross and Boyer.

As valve 310 travels from the first position to the second position, wash fluid may become trapped in a region 381 (see, e.g., FIG. 9) between top surface 360 of disk 356 and interior surface 362 of upper portion 318 of housing 314. When this occurs, fluid pressure may build up in region 381 which may affect movement and performance of valve 310. For example, the pressure build up may counteract the force of the flowing wash fluid and may prevent disk 356 from forming a proper seal with interior surface 362 of upper portion 318 of housing 314, or may even prevent valve 310 from reaching the second position at all. Therefore, it may be desirable to include features on diverter 300 which reduce pressure build up in region 381 and generate a net force that enables valve 310 to form a proper seal.

For example, as illustrated in FIG. 11, a honeycomb structure may be provided on the mating surface between valve 310 and housing 314. Accordingly, interior surface 362 of upper portion 318 of housing 314 may define a honeycomb structure 385 on the mating surface where the disk 356 of valve 310 forms a seal with housing 314. This honeycomb structure 385 may reduce pressure build-up by reducing the surface area upon which the fluid may be compressed.

Turning again to FIGS. 3 through 5, the diverter 300 may be configured to direct fluid from the pump 210 to the first outlet 303 in response to fluid pressure of the fluid from the pump 210 and to direct fluid from the pump 210 to another outlet, e.g., second outlet 304, in response to a change in the fluid pressure of the fluid from the pump 210. For example, upon an initial activation of the appliance 100, e.g., at the initiation of a cleaning operation or cycle, the pump 210 may be activated, supplying fluid under pressure to chamber 324, which, as described above may urge the diverter disk 356 to move from the first position as shown in FIG. 8 to the second position as shown in FIG. 9, and further aperture 372 may move into alignment with first outlet 303 as the disk 356 moves to the second position. Accordingly, the first position prior to the initial activation may be a first axial position and may correspond to a first circumferential position, e.g., wherein aperture 372 is positioned between fourth outlet 306 and first outlet 303. Further, the second position may be a second axial position and may correspond to a second circumferential position, e.g., wherein aperture 372 is aligned with first outlet 303. At a subsequent time, the pump 210 may be slowed or deactivated, such that the fluid pressure changes, e.g., decreases, such that the biasing element 370 urges the valve 310 back to the first axial position, which may then correspond to a third circumferential position, e.g., wherein the aperture 372 is positioned between the first outlet 303 and the second outlet 304. When the pump 210 may be sped up or reactivated, the fluid pressure may continue to change, e.g., increase, such that the valve 310 returns to the second axial position, this time corresponding to a fourth circumferential position, e.g., wherein the aperture 372 is aligned with the second outlet 304. Such cycles, e.g., changes in pressure, may be repeated until the aperture 372 is aligned with fourth outlet 306, which in the illustrated example would include the second axial position and an eighth circumferential position. For example, the pump 210 may be activated/deactivated and/or have its speed changed as in the foregoing description by the controller 137 according to a predetermined program or sequence of operations.

As another example, the pump 210 may change speeds or deactivate in response to a fluid level within the filter 250 and in particular within filtered volume 246. As mentioned above, pump 210 may include an intake 213. Further, the intake 213 may define an intake height, e.g., along the vertical direction V. When the fluid level within the filtered volume 246 falls below the intake height, fluid will not be drawn into the intake 213 and to the impeller 212, such that the pump 210 will become air-locked and not draw liquid through intake 213. As described in more detail below, fluid level within the filtered volume 246 may fall below the intake 213 when the filter 250 is fouled or in need of cleaning. Thus, as mentioned above, the diverter 300 may advantageously be utilized to divert fluid to the cleaning manifold 270 when cleaning is needed, and may automatically select between flowing fluid to the wash chamber 106 (such as via one or more of the spray assemblies) or to the cleaning manifold 270.

The level of fluid within filtered volume 246 may be a function of two flow rates, first a rate of flow into the filtered volume 246 through the filter 250, e.g., a filtration rate, and second a rate of flow out of the filtered volume 246, e.g., a pumping rate of pump 210. The filtration rate will be inversely proportional to a fouling status of the filter medium, for example, when relatively less soil is lodged in the holes or pores of the sidewall 252, fluid flow through the sidewall 252 may be relatively higher, and the level of fluid within the filter 250 may be at, for example, a first height as shown in FIG. 3. However, as the fouling status increases, e.g., as more soil becomes lodged in the holes or pores of the filter medium, fluid flow through the sidewall 252 may be reduced, and the height of fluid within the filter 250 may be at, for example, a lower height as shown in FIG. 4. The height of fluid in the filter 250 can thus be utilized as an indicator of whether sidewall cleaning 252 is required.

As illustrated in FIG. 4, when the fluid height is reduced sufficiently, e.g., to below the level of the intake 213, pump 210 deactivates, and the valve 310 may thus be moved to the first axial position by the biasing element 370. Also, as described above, valve 310 will rotate as valve 310 moves along the axial direction from the second axial position, e.g., as shown in FIG. 3, to the first axial position, e.g., as shown in FIG. 4. With the pump off, e.g., the pumping rate at zero, the level of fluid within the filtered volume 246 will gradually increase due to the filtration rate until the fluid level again reaches at or above the intake 213, such as a second height as is illustrated in FIG. 5, which is less than the first height as illustrated in FIG. 3. Once the fluid level within filtered volume 246 is sufficient to prime the pump 210, e.g., is at or above the intake 213, pump 210 may re-activate, pressurizing the chamber 324 which, as described above, moves the valve 310 back to the second axial position and to a subsequent circumferential position, e.g., such that the aperture 372 is aligned with fourth outlet 306 to provide fluid communication from chamber 324 to fourth outlet 306 and to cleaning manifold 270.

Figure 12:
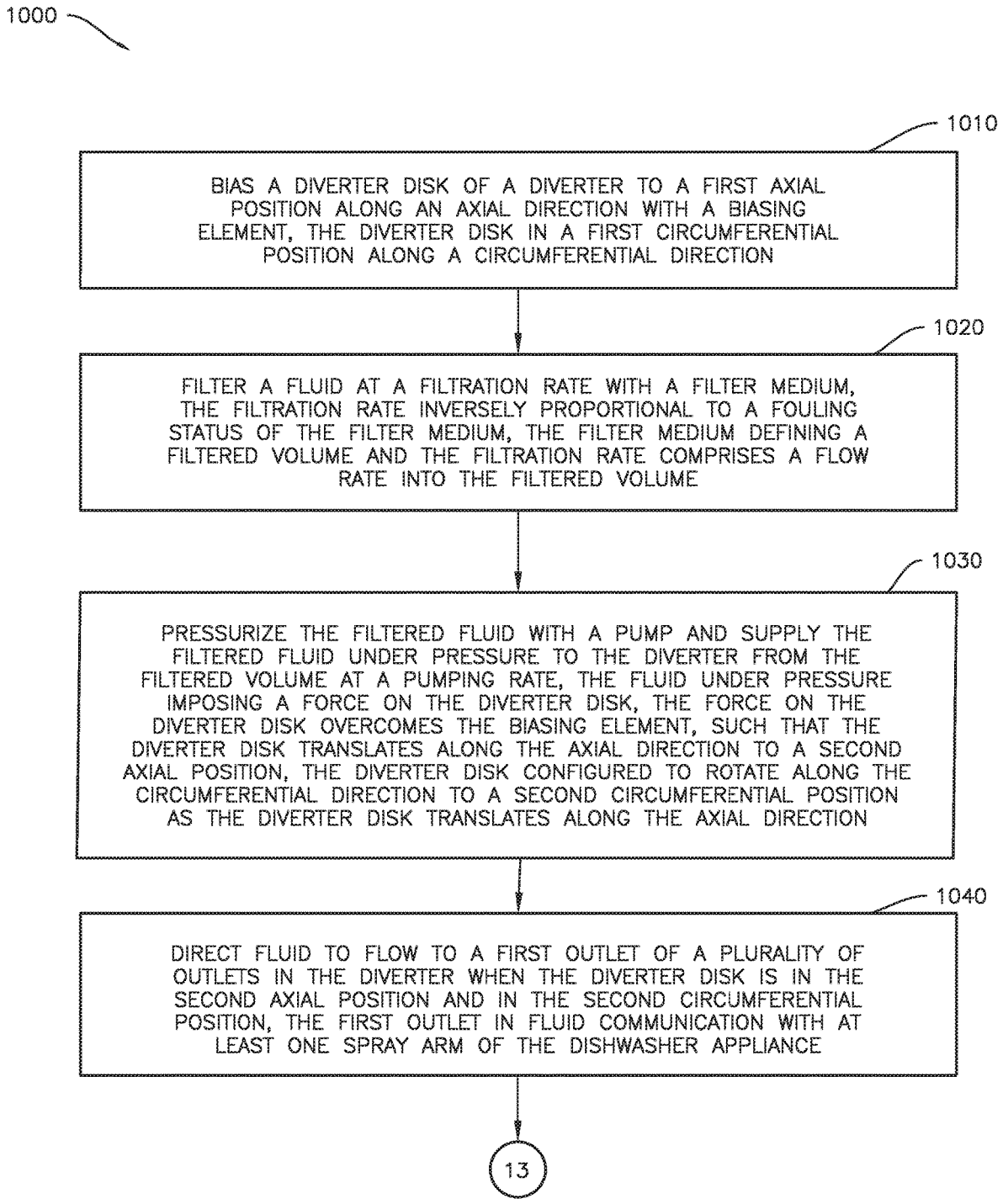
FIGS. 12 and 13 provide a flowchart of a method of operating an appliance according to an exemplary embodiment of the present subject matter.
Figure 13:
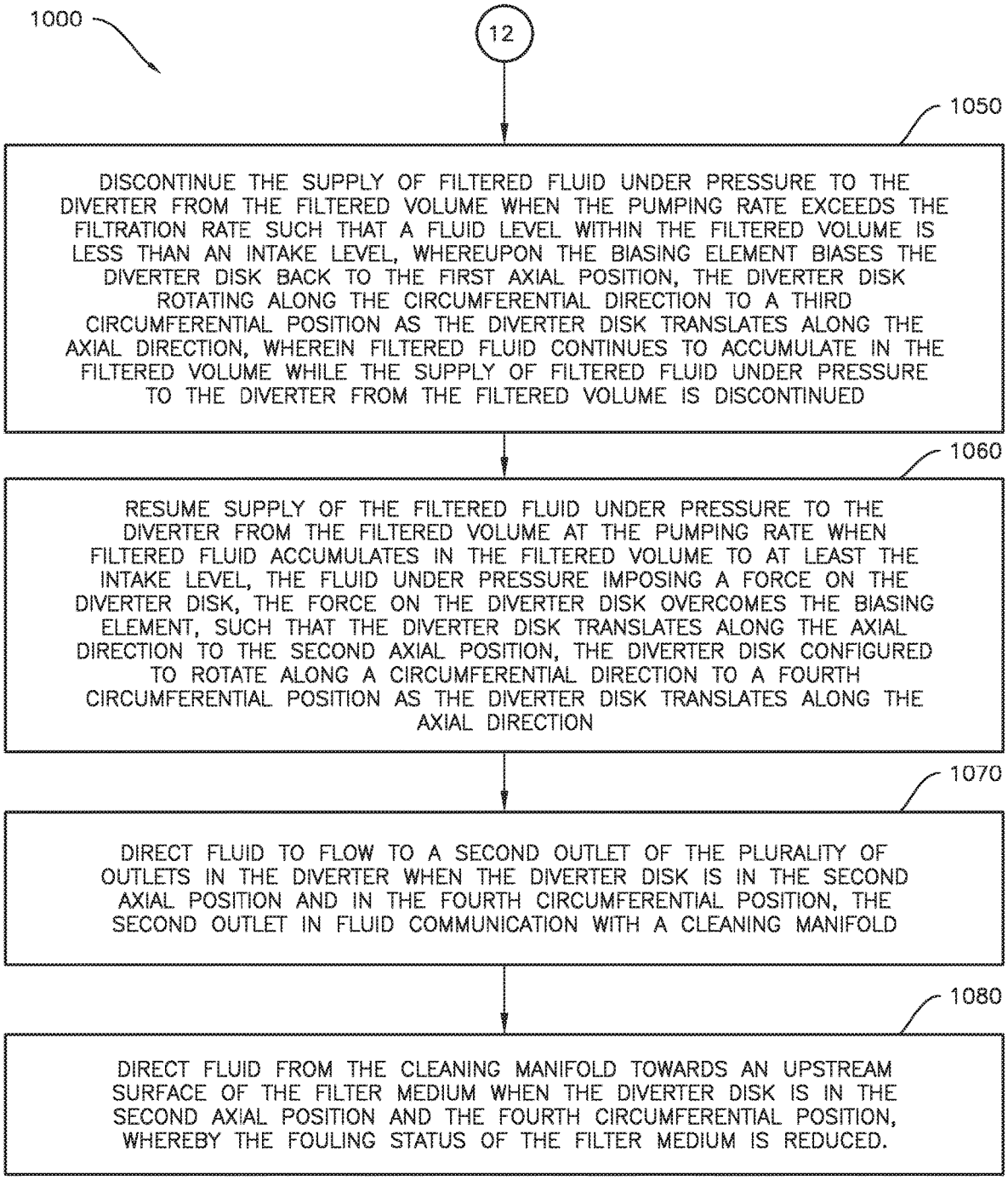

FIGS. 12 and 13 provide a simplified example for the sake of illustration, wherein a diverter may include two outlets, a first outlet in fluid communication with at least one spray arm 144, 148, 150 of the dishwasher appliance and a second outlet in fluid communication with the cleaning manifold 270. In this example, the method of operating the fluid circulation system may include step 1010 of biasing the diverter disk 356 of diverter 300 to a first axial position along axial direction A with the biasing element 370, where the diverter disk 356 is in a first circumferential position along the circumferential direction C. The method 1000 may also include a step 1020 of filtering a fluid at a filtration rate with the filter medium of filter 250, as described above. The method 1000 may further include a step 1030 of pressurizing the filtered fluid, e.g., fluid within the filtered volume 246, with pump 210 and supplying the filtered fluid under pressure to the diverter 300 from the filtered volume 246 at a pumping rate. As described above, the fluid under pressure imposes a force on the diverter disk 356 and the force on the diverter disk 356 overcomes the biasing element 370 such that the diverter disk 356 translates along the axial direction A to a second axial position and rotates along the circumferential direction C to a second circumferential position as the diverter disk 356 translates along the axial direction A. The method 1000 may then include a step 1040 directing fluid to flow to the first outlet of the plurality of outlets when the diverter disk 356 is in the second axial position and in the second circumferential position. As described above, when the filter 250 becomes fouled, the pumping rate exceeds the filtration rate until the fluid level within the filtered volume 246 is less than the intake level, and the method 1000 may then include a step 1050 of discontinuing the supply of filtered fluid under pressure to the diverter 300 from the filtered volume 246, whereupon the biasing element 370 biases the diverter disk 356 back to the first axial position and the diverter disk 356 rotates along the circumferential direction C to a third circumferential position as the diverter disk 356 translates along the axial direction A. Filtered fluid continues to accumulate in the filtered volume 246 while the supply of filtered fluid under pressure to the diverter 300 from the filtered volume 246 is discontinued. Thus, the method 1000 may further include a step 1060 of resuming supply of the filtered fluid under pressure to the diverter 300 from the filtered volume 246 at the pumping rate when filtered fluid accumulates in the filtered volume 246 to at least the intake level. The fluid under pressure imposes a force on the diverter disk 356 which overcomes the biasing element 370 such that the diverter disk 356 translates along the axial direction A to the second axial position and rotates along the circumferential direction C to a fourth circumferential position as the diverter disk 356 translates along the axial direction A. The method 1000 may further include a step 1070 of directing fluid to flow to the second outlet of the plurality of outlets when the diverter disk 356 is in the second axial position and in the fourth circumferential position. The method 1000 may further include a step 1080 of directing fluid from the cleaning manifold 270 towards an upstream surface 257 of the filter medium 250 when the diverter disk 356 is in the second axial position and the fourth circumferential position, whereby the fouling status of the filter medium 250 may be reduced.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims or if they include equivalent structural elements with insubstantial differences from the literal language of the claims.

What is claimed is:

1. A dishwasher appliance, comprising:

a tub that defines a wash chamber; and a fluid circulation system in fluid communication with the wash chamber, the fluid circulation system comprising:

a sump for receiving fluid, the sump comprising a sump chamber having a sidewall and a base wall;

a pump disposed within the sump chamber, the pump comprising an impeller;

a filter comprising a sidewall having an inner surface and an outer surface, the filter at least partially disposed within the sump chamber and surrounding the impeller;

a cleaning manifold disposed proximate the outer surface of the sidewall of the filter, the cleaning manifold defining a plurality of apertures for flowing fluid towards the outer surface of the sidewall of the filter;

a diverter comprising a housing having an inlet in fluid communication with the pump for receiving fluid from the pump, a diverter disk within the housing, and a biasing element, the diverter housing further comprising a plurality of outlets, the plurality of outlets including a first outlet and a second outlet, the second outlet in fluid communication with the cleaning manifold, wherein the diverter disk defines an axial direction, the diverter disk being rotatable about the axial direction to selectively permit fluid flow from the inlet of the diverter housing to one of the plurality of outlets of the diverter housing, wherein fluid pressure of the fluid from the pump causes the diverter disk to translate along the axial direction in a first direction, whereby the diverter directs fluid from the pump to the first outlet in response to fluid pressure of the fluid from the pump, and wherein the biasing element causes the diverter disk to translate along the axial direction in a second direction opposing the first direction when the fluid pressure of the fluid from the pump decreases, whereby the diverter directs fluid from the pump to the second outlet in response to a change in the fluid pressure of the fluid from the pump.

2. The dishwasher appliance of claim 1, wherein the diverter disk rotates about the axial direction as the diverter disk translates along the axial direction.

3. The dishwasher appliance of claim 1, wherein the diverter directs fluid from the pump to the first outlet when a fluid level within the filter is at a first height and directs fluid from the pump to the second outlet when a fluid level within the filter is at a second height that is less than the first height.

4. The dishwasher appliance of claim 3, wherein the pump further comprises a housing and an intake defined in the housing for drawing fluid to the impeller, the intake defining an intake height, and the first height is greater than the intake height.

5. The dishwasher appliance of claim 1, wherein the first outlet is in fluid communication with a recirculation system.

6. The dishwasher appliance of claim 1, wherein the first outlet is in fluid communication with a first spray arm, and the plurality of outlets from the diverter housing further comprises a third outlet in fluid communication with a second spray arm.

7. The dishwasher appliance of claim 6, wherein the diverter defines a circumferential direction, the diverter disk is rotatable in a single direction along the circumferential direction, and the plurality of outlets from the diverter housing are equidistantly spaced around the circumferential direction with the third outlet between the first outlet and the second outlet along the single direction of rotation of the diverter disk.

8. The dishwasher appliance of claim 1, wherein the diverter disk comprises an aperture, wherein the diverter disk is rotatable about the axial direction incrementally through a plurality of angular positions, the plurality of angular positions of the diverter disk corresponding to the plurality of outlets from the diverter housing such that the aperture is aligned with a respective one of the plurality of outlets in each of the plurality of angular positions.

9. The dishwasher appliance of claim 8, wherein the diverter housing defines a honeycomb structure that provides a mating surface which forms a seal with the diverter disk when the aperture is aligned with a respective one of the plurality of outlets.

10. The dishwasher appliance of claim 8, wherein the plurality of angular positions comprises two angular positions spaced apart by one hundred and eighty degrees and the plurality of outlets comprises two outlets spaced apart by one hundred and eighty degrees.

11. The dishwasher appliance of claim 8, wherein the plurality of angular positions comprises three angular positions spaced apart by sixty degrees and the plurality of outlets comprises three outlets spaced apart by sixty degrees.

12. The dishwasher appliance of claim 8, wherein the plurality of angular positions comprises four angular positions spaced apart by ninety degrees and the plurality of outlets comprises four outlets spaced apart by ninety degrees.

13. The dishwasher appliance of claim 8, wherein the diverter further comprises a positioning assembly capable of causing the diverter disk to rotate about the axial direction, wherein the positioning assembly comprises:

a cylindrical well defined by the diverter housing;

a cylindrical shaft connected to the diverter disk and extending along the axial direction, the shaft slidably received within the well of the diverter housing such that the diverter disk translates along the axial direction between a first position and a second position, the shaft further defining an interior channel having a plurality of cams positioned on the shaft and projecting radially inward from the shaft into the interior channel;

a boss extending along the axial direction from the housing into the interior channel of the shaft, the boss defining a plurality of guide elements positioned on the boss and extending radially outward from the boss; and wherein the guide elements and the cams contact each other when the diverter disk translates along the axial direction into the second position so as to cause the diverter disk to rotate about the axial direction incrementally through the plurality of angular positions.

14. The dishwasher appliance of claim 13, wherein the boss defines a recess into which the biasing element is slidably received, the biasing element comprising:

a plunger comprising a plunger shaft connected with a plunger head, the plunger head having a larger diameter than the plunger shaft; and a spring received onto the plunger shaft and biased against the plunger head.

15. The dishwasher appliance of claim 1, wherein the diverter disk has a first face oriented towards the plurality of outlets and an opposing second face, and wherein a plurality of arcuate ribs are disposed on the second face.

* * * * *